United States Patent [19]

Focke et al.

[11] Patent Number: 4,763,779

[45] Date of Patent: Aug. 16, 1988

[54] SHOULDER BOX FOR CIGARETTES OR THE LIKE

[75] Inventors: Heinz Focke; Kurt Liedtke, both of Verden, Fed. Rep. of Germany

[73] Assignee: Focke & Co., Verden, Fed. Rep. of Germany

[21] Appl. No.: 636,757

[22] Filed: Aug. 1, 1984

[30] Foreign Application Priority Data

Aug. 16, 1983 [DE] Fed. Rep. of Germany ..... 3329455

[51] Int. Cl.[4] ..... A24F 15/00; B65D 85/00

[52] U.S. Cl. ..... 206/268; 131/329

[58] Field of Search ..... 131/329; 206/286

[56] References Cited

U.S. PATENT DOCUMENTS 3,596,823 8/1971 Zitzelman ..... 206/268

FOREIGN PATENT DOCUMENTS 2847585 5/1980 Fed. Rep. of Germany ..... 131/329
2854443 7/1980 Fed. Rep. of Germany .
0879504 2/1943 France .
0461794 2/1937 United Kingdom .
0530316 12/1940 United Kingdom ..... 206/268

*Primary Examiner*—V. Millin
*Attorney, Agent, or Firm*—Sughrue, Mion, Zinn, Macpeak and Seas

[57] ABSTRACT

An inner wrapping for cigarette shoulder boxes is designed in such a way that, on the one hand, maximum moisture and aroma retention is guaranteed, but on the other hand the design of the inner wrapping is in keeping with processing by machine and favorable handling. The upper wall of the inner wrapping (25) is provided with an extraction orifice (28) which leads up to one of the ends of the cigarettes (24) and which is covered by a closing flap (35) which in the closed position covers the edge regions of the orifice.

16 Claims, 6 Drawing Sheets

SHOULDER BOX FOR CIGARETTES OR THE LIKE

BACKGROUND OF THE INVENTION

The invention relates to a cigarette pack with a box portion and a hinged lid connected to the box along an axis of articulation. Such a pack is generally known as a shoulder box. A group of cigarettes wrapped in an inner tin foil wrapping is received in the box such that they lie flat therein, usually in two layers one above the other.

Shoulder boxes are usually made from stiff cardboard. When the shoulder box is closed, the box portion is surrounded by the hinged lid along an inwardly set back edge.

In shoulder boxes of this type, the cigarettes are wrapped in an inner wrapping made of tin foil lined with a glassine ply. The inner wrapping is designed and arranged in such a way that its top or upper wall consists of at least two closing tabs partially overlapping but unconnected to one another. To extract cigarettes, these are swung to one side so that the complete surface of the upper layer of cigarettes is exposed.

An inner wrapper so designed allows for a substantial loss of aroma and moisture from the cigarette tobacco. Another disadvantage is that the entire upper layer of cigarettes is always exposed after the pack is opened. Finally, because of its design the inner wrapping is also unsuitable for holding the group of cigarettes together in the form of a "tin foil block".

SUMMARY OF THE INVENTION

The object of the invention is to provide a shoulder box with an inner wrapping guaranteed to protect against losses of moisture and aroma without access to the cigarettes being impaired.

To achieve this object, the shoulder box according to the invention is provided with an inner wrapping having a top or upper wall with a stamped extraction orifice which extends up to a transverse edge of the upper wall which orifice is covered by a closing flap of at least the size of the extraction orifice.

Therefore, in the shoulder box according to the invention the upper side of the group of cigarettes is covered by a substantially closed upper wall of the inner wrapping. The extraction orifice formed in part of the upper wall is covered by a closing flap which is preferably designed and arranged to cover over the edge of the extraction orifice. To this end, there is provided a lateral and transverse edge strip portion of the closing flap. The closing flap can rest loosely on the upper wall or on the cigarettes or alternatively can be releasably attached to the adjacent part of the upper wall by a peel-seal connection. To extract cigarettes, the relatively small closing flap is swung back to expose a portion of the cigarettes. For this purpose, a transverse edge of the inner wrapping forms the pivot axis for the closing flap.

According to a further feature of the invention, the extraction orifice and consequently the closing flap are made with a maximum width smaller than the width of the upper wall and with a decreasing width towards its free end.

A further important feature of the invention is that, starting from the transverse edge of the extraction orifice coincident with the upper wall of the inner wrapping, preferably two separating lines are arranged to extend to the opposite transverse edge of the upper wall. This makes it possible to detach an essentially central opening strip from the upper wall so that an orifice extending over the entire length of the upper wall is formed. Further transversely directed separating lines can adjoin the ends of these separating lines, thus resulting in side tabs of the upper wall which can be swung open.

Further features of the invention relate to the design of the blank form which the inner wrapping is formed, to the folding of the blank and to the formation of the orifices for the extraction of cigarettes.

BRIEF DESCRIPTION OF THE DRAWINGS

Preferred embodiments of the invention are explained in more detail below with reference to the drawings in which.

DETAILED DESCRIPTION OF THE PREFERRED EMBODIMENTS

Figure 1:
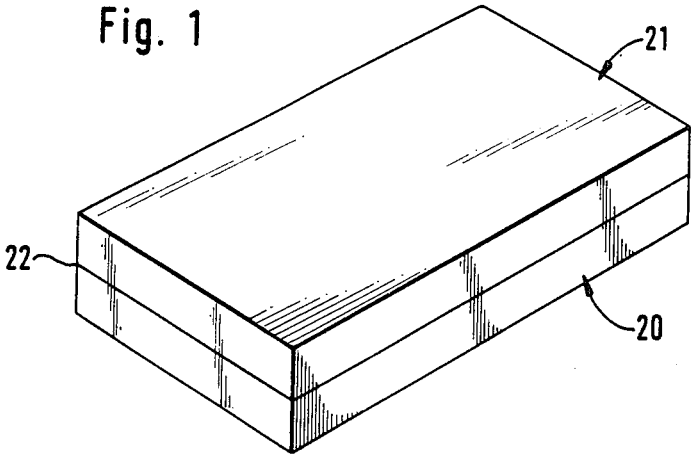
FIG. 1 shows a perspective view of a shoulder box in the closed position.

The preferred exemplary embodiments illustrated are obtained from shoulder boxes which consist of a box part 20 and a hinged lid 21. The box and lid are pivotably connected along an axis of articulation 22. In the closed position, the hinged lid 21 surrounds a collar 23 of the box 20. This collar 23 is arranged in the box as a strip of material running all around the box and inwardly set back in the upper part of the box.

Accommodated within the box 20 is a group of cigarettes 24 which is surrounded by an inner wrapping 25. A cuboid tin foil block 26 obtained in this way preferably contains three layers of cigarettes 24. The cigarettes 24 are aligned in the direction of the longitudinal axis of the shoulder box and thus parallel to the axis of articulation 22.

Figure 2:
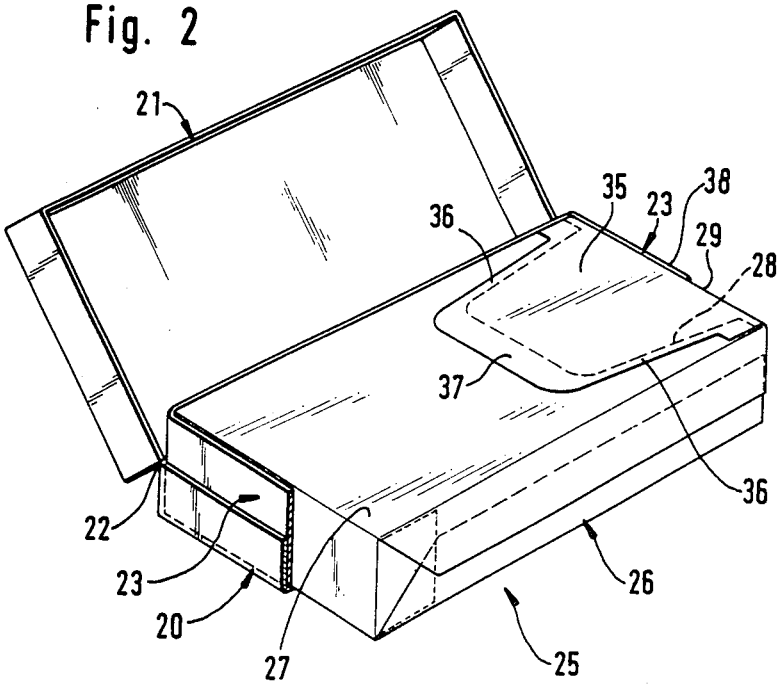
FIG. 2 shows the shoulder box according to FIG. 1 in the open position, with the inner wrapping closed.

The inner wrapping 25 is designed and arranged in such a way that an upper wall 27 as illustrated in FIG. 2 is obtained. As a result of appropriate stamping, an extraction orifice 28 is arranged in this upper wall, specifically in an end region facing one end of the cigarettes 24. The extraction orifice 28 extends up to a marginal transverse edge 29 of the tin foil block 26. As a result, the ends of the cigarettes 24 are esxposed for the purpose of extraction. The extraction orifice is limited here by side edges 30 and 31 arranged to converge towards one another and by a transverse edge 32 adjoining these side edges. The width of the extraction orifice 28 is less than the width or transverse dimension of the upper wall 27, so that residual walls 33 remain next to the extraction orifice 28. The above-mentioned residual walls 33 are separated from an end wall of the inner wrapping by a gap 34.

The extraction orifice 28 can be covered by a closing flap 35. Because of the design of the latter or because of its relative arrangement to the extraction orifice 28, in the closed position, the closing flap 35 laterally covers the extraction orifice 28 by means of an edge strip 36 and by means of a transverse strip 37.

Figure 3:
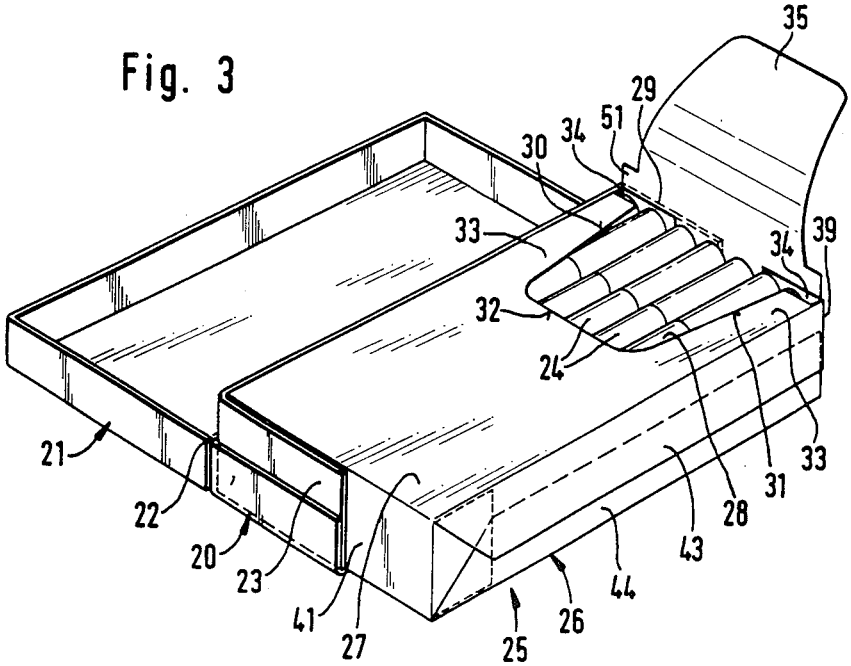
FIG. 3 shows the shoulder box of FIGS. 1 and 2 with the inner blank open for the extraction of cigarettes.
Figure 6:
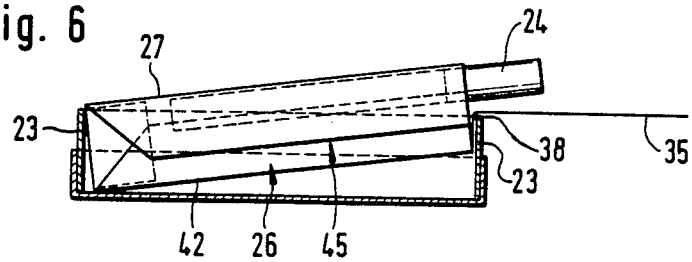
FIG. 6 shows a longitudinal secton corresponding to FIG. 5 with the cigarettes in a position for the extraction.

For the extraction of cigarettes 24, the closing flap 35 is not only swung back, for example into a position according to FIG. 3, but also folded over an upper collar edge 38 transverse to the cigarettes 24. By pulling on the closing flap, the tin foil block 26 is lifted out of the box 20 as shown in FIG. 6. In this way, an end of the cigarettes 24 is exposed to make cigarette removal easy. This lifting movement becomes possible because the closing flap or an end wall 39 connected to it is not joined to laterally adjacent portions of the inner wrapping.

Figure 4:
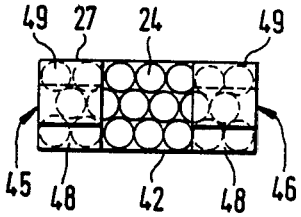
FIG. 4 shows an end view of a group of cigarettes surrounded by the inner wrapping.
Figure 5:
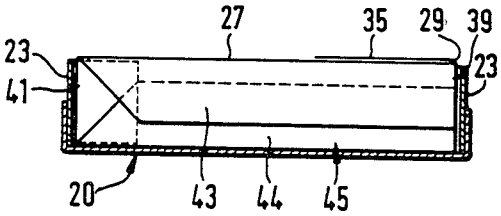
FIG. 5 shows a longitudinal section through the open shoulder box positioned according to FIG. 2.
Figure 7:
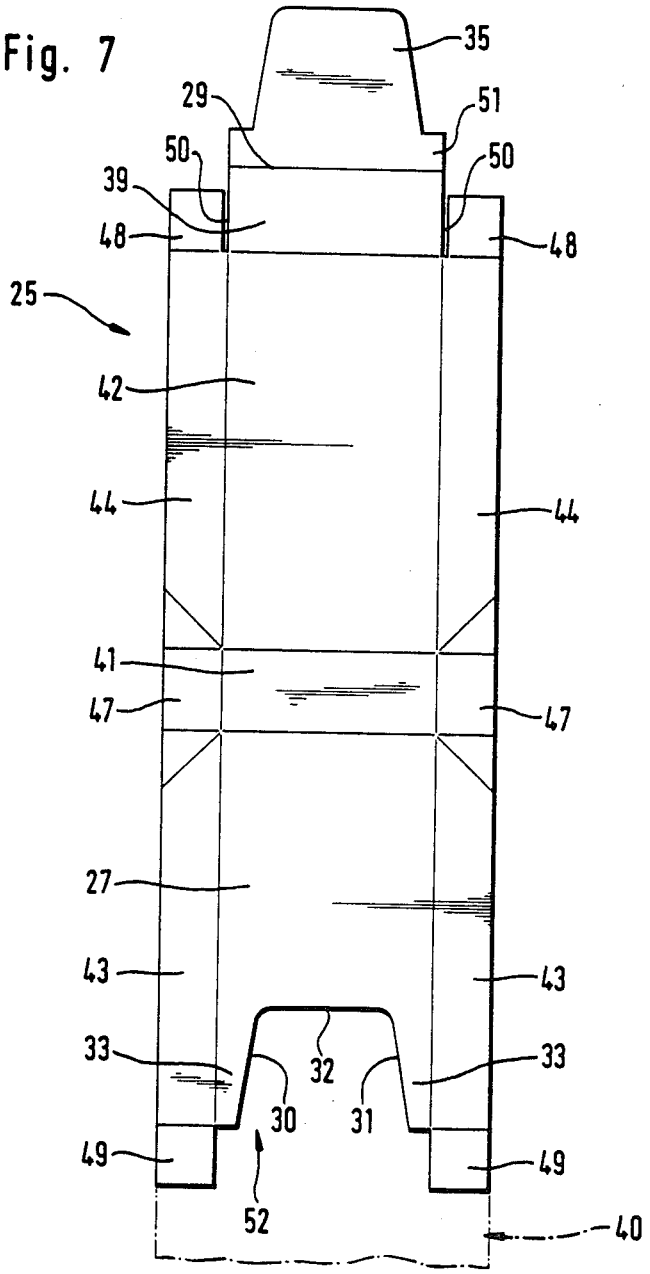
FIG. 7 shows an inner blank for a shoulder box according to FIGS. 1 to 6.
Figure 8:
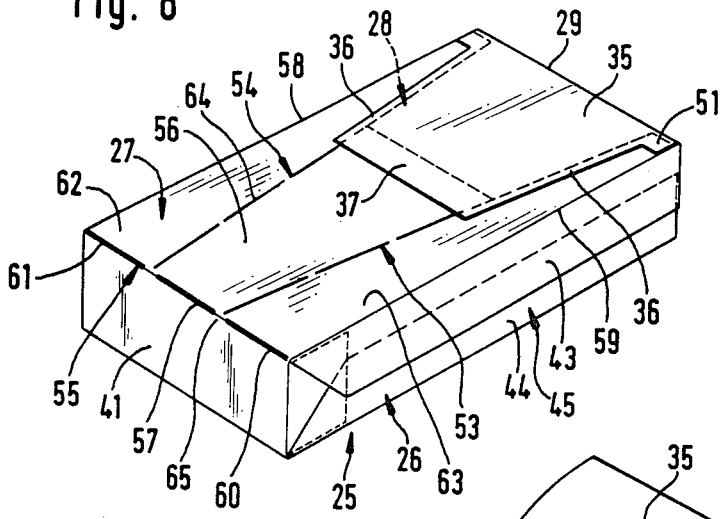
FIG. 8 shows in perspective a tin foil inner wrapping according to a second embodiment of the invention.
Figure 9:
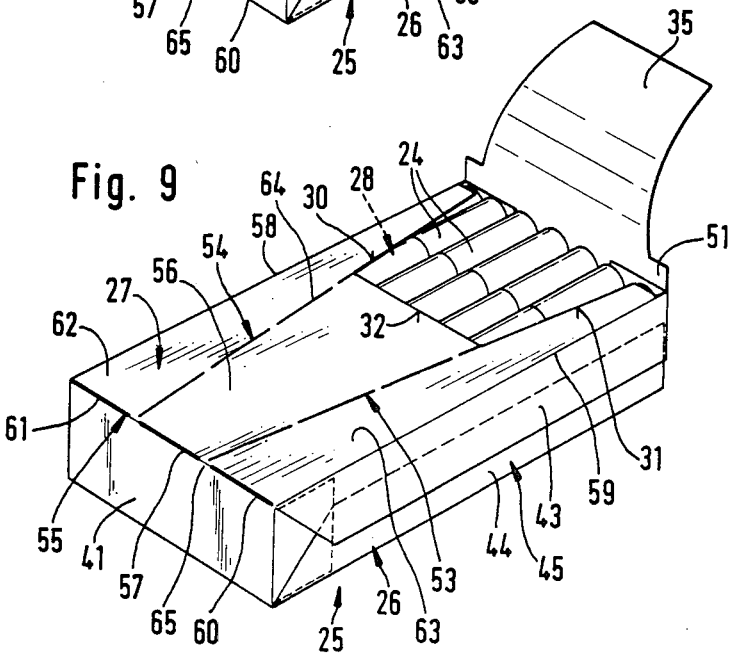
FIG. 9 shows the tin foil inner wrapping according to FIG. 8, with the closing flap opened.
Figure 10:
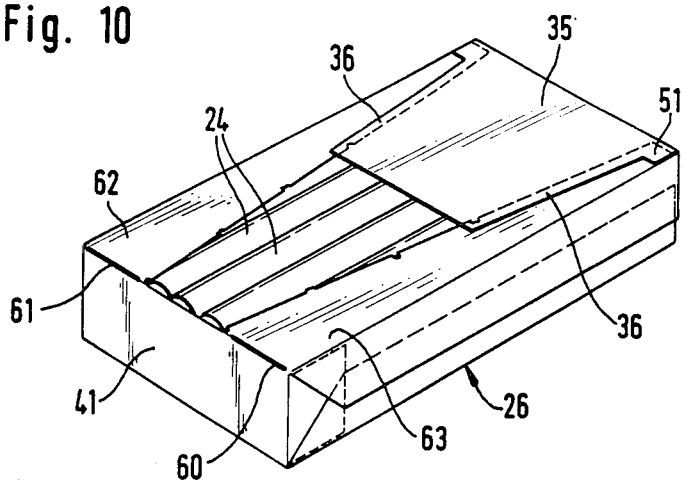
FIG. 10 shows the tin foil inner wrapping according to FIGS. 8 and 9 after the closing flap has been reclosed.

The inner wrapping 25 for a shoulder box designed in this way is illustrated in FIG. 7. A blank for forming the inner wrapping 25 can be severed from a continuous heat of material 40. The design is such that the longer walls extend successively in the longitudinal direction of the sheet of material 40. Accordingly, the upper wall 27, an end wall 41, a lower wall 42, the end wall 39 and, adjoining this, the closing flap 35 follow one another. Side tabs 43 are arranged laterally in the region of the upper wall 27, and corresponding side tabs 44 are similarly arranged in the region of the lower wall 42. In the finished tin foil block 26, these form side walls 45 and 46 when the side tabs 43 and 44 are folded over one another. Corner tabs 47 adjoin the end wall 41 as a continuation of and a connection between the side tabs 43 and 44, respectively. Similar corner tabs 48 and 49 are located in the region of the end wall 39 and at the opposite end of the inner blank 25. As already mentioned, the corner tabs 48 are not connected to the adjacent end wall 39, but are divided off from this by a severing cut 50. The corner tabs 48 and 49 also have smaller dimensions than the associated end wall 39 in the longitudinal direction of the blank. The end tabs 48 and 49 folded into the plane of the end wall 39, in particular towards the head ends of the cigarettes 24, overlap one another only partially (FIG. 4).

A special feature of the present blank forming inner wrapping 25 is that the two end walls 39 and 41 are designed as a continuous wall without folds. The closing flap 35 adjoining the end wall 39 is obtained when the extraction orifice 28 is stamped in the adjacent blank. The corner tabs 48 and 49 succeeding one another in the longitudinal direction of the sheet of material 40 result in a constructive length which allows the closing flap to be made longer or larger than the extraction orifice 28 by the amount of a transverse strip 51. A trapezoidal part of the closing flap adjoining the rectangular transverse strip 51 corresponds in size and shape to the extraction orifice 28. In the closed position, the transverse strip 51, when folded along the transverse edge 29, forms the upper limit of the end wall 39 in the plane of the upper wall 27. The trapezoidal part of the closing flap is thereby displaced in the longitudinal direction of the upper wall 27 relative to the extraction orifice 28, specifically by an amount corresponding to the dimension of the transverse strip 51 in the longitudinal direction of the blank. Because of this transverse strip 51 over the full width of the end wall 39, even this end region of the tin foil block 26 is largely sealed off. The gaps 34 between the upper wall 27 in the region of the extraction orifice 28 and the end wall 39 are obtained when material is stamped out at 52 over the full width of the upper wall 27 in the region of the blank adjacent to the extraction orifice 28.

FIGS. 8 to 12 illustrate another embodiment of the inner wrapping 25 of the invention. Its basic design corresponds to that of the embodiment already described, with the exception of an angular design of the closing flap 35 and extraction orifice 28, whereas these parts of the blank are partially rounded in the embodiment previously described.

According to the second embodiment of the invention, the extraction orifice 28 is enlarged by providing separating lines 53, 54 in the otherwise closed part of the upper wall. In the exemplary embodiment illustrated, separating lines 53 and 54 extend, as an extension of side edges 30 and 31 of the extraction orifice 28, towards the opposite transverse edge 55 of the upper wall. These separating lines 53, 54 define an essentially trapezoidal strip of material 56 which can be pulled off as a further opening flap when the separating lines 53, 54 are severed. The upper cigarettes 24 lying in the central region are thereby exposed over their full length. The strip of material 56 can be detached completely and discarded or can be folded back into the initial position in a similar way to the closing flap 35. In the first-mentioned case, the strip of material 56 can be detached from the remaining part of the inner wraping 25 in the region of the transverse edge 55 by means of a transverse separating line 57.

Figure 11:
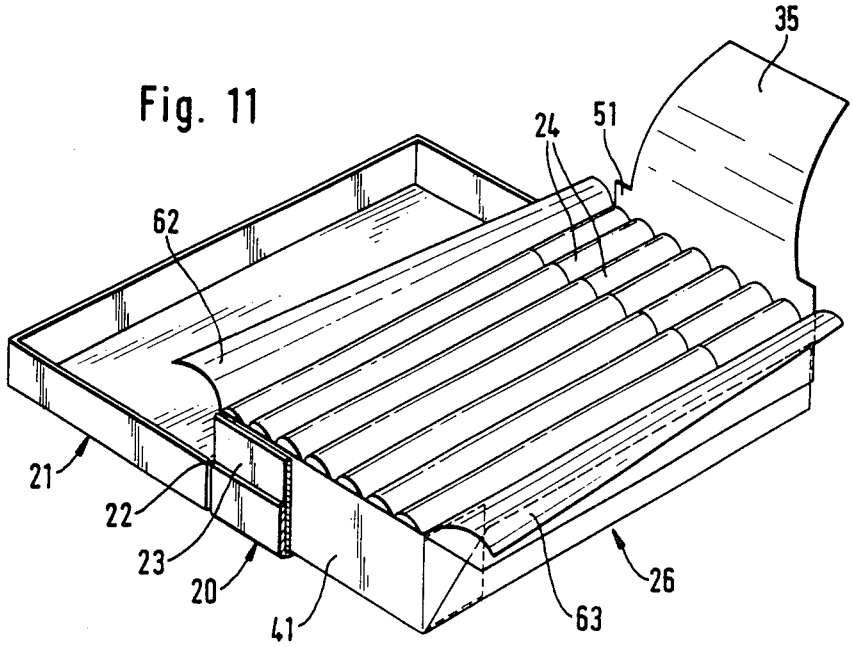
FIG. 11 shows a shoulder box with a tin foil inner wrapping according to FIGS. 8 and 9 in a fully open position.

Furthermore, in the exemplary embodiment illustrated, further transverse separating lines 60 and 61 leading to the longitudinal edges 58 and 59 of the upper wall 27, are provided at the ends of the separating lines 53, 54, likewise in the region of the transverse edge 55. When these transvserse separating lines 60 and 61 are severed, it is possible to form side tabs 62 and 63 which, when slung sideways, make it possible to expose the complete upper layer of cigarettes 24 (FIG. 11). The side tabs 62, 63 remain connected to the remaining part of the inner wrapping 25.

The longitudinal separating lines 53, 54 and the transverse separating lines 57, 60, 61 can be formed in various ways, but appropriately will consist of stamped portions 64 with residual connections 65. The residual connections 65 are arranged at suitable distances from one another. In the exemplary embodiment illustrated, residual connections 65 of this type are in any case arranged in the region where the longitudinal separating lines 53, 54 and the transverse separating lines 57 or 60 and 61 meet one another. Raised corners of the inner wrapping 25 are thereby avoided.

Figure 12:
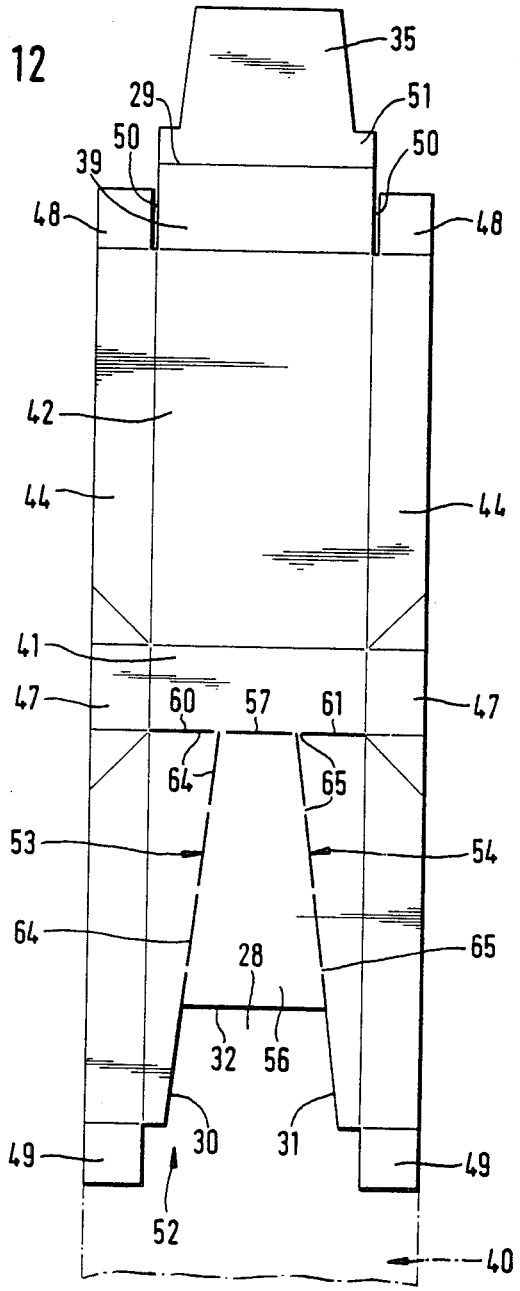
FIG. 12 shows a blank for the inner wrapping of a shoulder box according to FIGS. 8 to 11.

A blank for forming an inner wrapping 25 of this type is illustrated in FIG. 12. In contrast to the exemplary embodiment of FIG. 7, the blank is provided with the stamped portions 64 and residual connections 65 for defining the separating longitudinal lines 53, 54 and the transverse separating lines 57 or 60 and 61. Accordingly, blanks completely ready for processing are severed from the sheet of material 40.

We claim:

1. A shoulder box with a box portion (20) and a hinged line (21) connected along an axis of articulation, said shoulder box for receiving a group of cigarettes (24) wrapped in a tin foil inner wrapping, said group of cigarettes to be aligned to lie flat in the box portion parallel to the axis of articulation, said inner wrapping comprising an upper wall (27) with an extraction orifice (28) extending up to a transverse edge (29) of said upper wall (27) and a closing flap (35) for covering said orifice, said closing flap (35) being at least the size of said extraction orifice (28), said closing flap (35) being connected to an end wall (39) of said inner wrapping (25) at said transverse edge (29) of said upper wall.

2. A shoulder box as claimed in claim 1, wherein the extraction orifice (28) has a smaller width than the upper wall (27), and wherein the closing flap (35) covers the extraction orifice (28) by means of a lateral edge strip (36) and a transversely directed edge. strip (37).

3. A shoulder box as claimed in claim 2, wherein the width of said extraction orifice (28) and said closing flap (35) increases in the direction toward said transverse edge (29) of the upper wall (27).

4. A shoulder box as claimed in claim 3, wherein the closing flap (35) is a stamped out portion of an upper wall, with an extraction orifice (28) remaining after the closing flap is stamped out such that the extraction orifice and the closing flap (35) have identical outlines, said flap (35) being displaced with respect to the extraction orifice (28) when in the closed position.

5. A shoulder box as claimed in claim 1, wherein the closing flap (35) has, adjacent to said transverse edge (29), a transverse strip (51) corresponding to the full width of the upper wall (27).

6. A shoulder box as claimed in claim 5, wherein the end wall (39) connected to the closing flap (35) is of one piece construction and is connected to a lower wall (42) along its transverse side located opposite the closing flap (35).

7. A shoulder box as claimed in claim 6, wherein corner tabs (48) adjacent to the end wall (39) and separated from said end wall (39) by a longitudinal severing cut (50) have a smaller longitudinal dimension than the longitudinal dimension of the end wall (39).

8. A shoulder box as claimed in claim 1, wherein the upper wall (27), an end wall (41) and the lower wall (42) are arranged successively in a longitudinal direction in the blank forming the inner wrapping (25), and wherein the extraction orifice (28) is arranged as a stamped-out portion on the upper wall 27 of the inner wrapping (25) and the closing flap (35) together with the transverse strip (51) and the end wall (39) is arranged to extend from the lower wall (42).

9. A shoulder box as claimed in claim 1, wherein, starting from the extraction orifice (28), in the longitudinal direction of the upper wall (27), there is provided at least one separating line (53, 54) in the upper wall and leading up to a transverse edge (55) of the inner wrapping located opposite the extraction orifice (28).

10. A shoulder box as claimed in claim 9, wherein, starting from a transverse edge (32) of the extraction orifice (28), two longitudinal separating lines (53, 54) are provided at a distance from one another to the opposite transverse edge (55).

11. A shoulder box as claimed in claim 10, wherein the longitudinal separating lines (53, 54) are provided as an extension of the converging side edges (30, 31) of the extraction orifice (28).

12. A shoulder box as claimed in claim 9, wherein transversely to the longitudinal separating lines (53, 54) transverse separating lines (57, 60, 61) are formed in the region of the transverse edge (55).

13. A shoulder box as claimed in claim 12, wherein at least some of the transverse separating lines (60, 61) extend into the region of lateral longitudinal edges (58, 59) of the upper wall (27).

14. A shoulder box as claimed in claim 12, wherein a transverse separating line (57) is arranged at the end of an approximately central strip of material (56) limited by the longitudinal separating lines (53, 54).

15. A shoulder box as claimed in claim 9, wherein the longitudinal and transverse separating lines (53, 54; 57; 60, 61) consist of stamped portions (64) with residual connections (65) remaining between these stamped portions.

16. A shoulder box as claimed in claim 15, wherein a residual connection (65) is arranged in the region where the longitudinal separating lines (53, 54) and transverse separating lines (60 and 61 or 57) meet.

* * * * *